US010193277B2

(12) United States Patent
Leigh et al.

(10) Patent No.: US 10,193,277 B2
(45) Date of Patent: Jan. 29, 2019

(54) PULL-TABS FOR DISENGAGING A CABLE ASSEMBLY FROM A RECEPTACLE

(71) Applicant: Hewlett Packard Enterprise Development LP, Houston, TX (US)

(72) Inventors: Kevin B. Leigh, Houston, TX (US); John Norton, Houston, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/550,806

(22) PCT Filed: Feb. 18, 2015

(86) PCT No.: PCT/US2015/016283
§ 371 (c)(1),
(2) Date: Aug. 14, 2017

(87) PCT Pub. No.: WO2016/133499
PCT Pub. Date: Aug. 25, 2016

(65) Prior Publication Data
US 2018/0026399 A1 Jan. 25, 2018

(51) Int. Cl.
*H01R 13/633* (2006.01)

(52) U.S. Cl.
CPC ..... *H01R 13/6335* (2013.01)

(58) Field of Classification Search
CPC ..... H01R 13/6275; H01R 13/6658; H01R 13/6335; H01R 13/6594; H01R 2107/00;
(Continued)

(56) References Cited

U.S. PATENT DOCUMENTS 3,521,332 A 7/1970 Kramer
4,386,752 A 6/1983 Pavlak
(Continued)

FOREIGN PATENT DOCUMENTS

CN 101789575 7/2010
JP 2007317434 12/2007
(Continued)

OTHER PUBLICATIONS

LC Right Angle Clip Feb. 22, 2013, <http://www.senko.com/fiber/pdf_brochure/FeaturesBrochure_2013-v5.pdf >.
(Continued)

*Primary Examiner* — Truc Nguyen
(74) *Attorney, Agent, or Firm* — Hewlett Packard Enterprise Patent Department

(57) ABSTRACT

One example of a cable assembly includes a cable and a cable connector attached to one end of the cable. The cable connector generally includes latching features to couple the cable connector to a receptacle. The cable assembly includes a sleeve enclosed around at least a portion the cable and pull-tabs disposed along a perimeter of a first end of the sleeve. As an example, at least one of the pull-tabs is accessible to actuate the latching features when the cable connector is to disengage from the receptacle. The cable assembly includes attachment features to couple the sleeve to the latching features, wherein the attachment features are to actuate the latching features when at least one of the pull-tabs is pulled.

13 Claims, 8 Drawing Sheets

(58) Field of Classification Search
CPC ..... H01R 24/60; H01R 13/46; H01R 13/506; H01R 13/65802; H01R 13/659; H01R 2103/00; H01R 24/00; H01R 9/038; H01R 13/508
See application file for complete search history.

(56) References Cited

U.S. PATENT DOCUMENTS 4,767,338 A 8/1988 Dennis
5,263,671 A 11/1993 Baum
5,386,487 A 1/1995 Briggs
5,564,939 A * 10/1996 Maitani ..... H01R 13/6335 439/352
5,586,906 A * 12/1996 Staros ..... H01R 13/502 439/320
5,669,590 A 9/1997 Przewodek
5,993,237 A * 11/1999 Kern, Jr. ..... H01R 24/62 439/344
6,062,516 A 5/2000 Rizzo
6,175,080 B1 1/2001 Nightingale
6,216,410 B1 4/2001 Haberman
6,219,479 B1 4/2001 Madden
6,364,721 B2 4/2002 Stewart, III
6,378,811 B1 4/2002 Potter
6,669,150 B2 12/2003 Benoit
6,808,116 B1 10/2004 Eslambolchi
6,887,091 B1 5/2005 Wu
6,926,237 B2 8/2005 Shereyk
7,055,784 B2 6/2006 Stigler
7,119,280 B1 10/2006 Ray
7,241,163 B1 * 7/2007 Cox ..... B01J 19/126 439/373
7,294,789 B1 11/2007 Watthanasintham
7,318,740 B1 * 1/2008 Henry ..... H01R 13/6275 439/352
7,494,363 B1 2/2009 Wu
7,605,707 B2 10/2009 German
7,622,682 B2 11/2009 Malin
7,648,392 B2 * 1/2010 Chambers ..... A61G 7/05769 141/313
7,661,979 B2 2/2010 Hughes
7,789,718 B2 9/2010 Desard
7,845,859 B2 * 12/2010 Roth ..... G02B 6/3821 29/749
8,212,145 B2 7/2012 Nagai
8,340,123 B2 12/2012 Barbieri
8,475,197 B2 * 7/2013 Zerebilov ..... H01R 13/6275 439/352
8,585,426 B2 11/2013 Zerebilov
8,596,882 B2 12/2013 Smrha et al.
8,636,544 B1 1/2014 Briant
8,639,082 B2 1/2014 Haley
8,867,883 B2 10/2014 Crain
8,882,514 B2 11/2014 Enge
8,910,912 B2 12/2014 Child
9,088,119 B2 7/2015 Baker
2004/0048506 A1 * 3/2004 Chung ..... H01R 13/6335 439/152
2004/0115997 A1 6/2004 Scherer
2005/0098688 A1 5/2005 Miarka
2005/0224585 A1 10/2005 Durrant
2005/0271328 A1 12/2005 Ohtsu
2006/0148279 A1 7/2006 German
2006/0189180 A1 8/2006 Lang
2007/0111598 A1 5/2007 Quilici
2007/0232132 A1 10/2007 Ling
2010/0062627 A1 3/2010 Ambo
2010/0065327 A1 3/2010 Lin
2010/0130063 A1 * 5/2010 Lang ..... H01R 13/6658 439/607.17
2011/0034082 A1 2/2011 Zhu
2011/0165785 A1 7/2011 Lindner
2011/0168423 A1 7/2011 Hagi
2012/0129382 A1 5/2012 Regnier
2012/0251064 A1 10/2012 Crain
2013/0183846 A1 * 7/2013 Kappla ..... G02B 6/4246 439/350
2013/0231011 A1 9/2013 Sytsma
2014/0038447 A1 2/2014 Brown
2015/0244109 A1 * 8/2015 Byczkiewicz ..... H01R 13/6335 439/352

FOREIGN PATENT DOCUMENTS

JP 2009076375 4/2009
KR 1020100068002 6/2010
TW I267238 11/2006
TW M430018 5/2012
WO WO-2014043426 3/2014

OTHER PUBLICATIONS

"8 Channel Dula Multi-lane Sata2 Enclosure Device Bracket Scsi Opening," Retrieved from Internet Sep. 15, 2014, http://www.satacable.com/8-channel-dula-multi-lane-sata2-enclosure-device-bracket-scsi-opening.html.
Accessories for Retaining Helawrap Open Cable Cover HWCLIP08, 3 pages; Retrieved from Internet Sep. 1, 2015, < http://www.hellermanntyton.co.uk/site/products/protective-tubing-and-spiral-binding/hwclip08/161-64002 >.
Dennis Martin, "Demartek Storage Networking Interface Comparison," May 9, 2014, http://www.demartek.com/Demartek_Interface_Comparison.html.
Neer, et al.; "Advanced SAS Connections Converge at 3.0," Retrieved form Internet Sep. 15, 2014; 5 pages; http://www.serialstoragewire.net/Articles/2009_12/molex.html.
PCT/ISA/KR, International Search Report and Written Opinion, dated Nov. 11, 2015, PCT/US2015/016283, 9 pps.
PCT/ISA/KR, International Search Report and Written Opinion, dated Jun. 19, 2015, PCT/US2014/057858, 12 pps.
PCT/ISA/KR, International Search Report and Written Opinion, dated Nov. 20, 2015, PCT/US2015/017964, 10 pps.

* cited by examiner

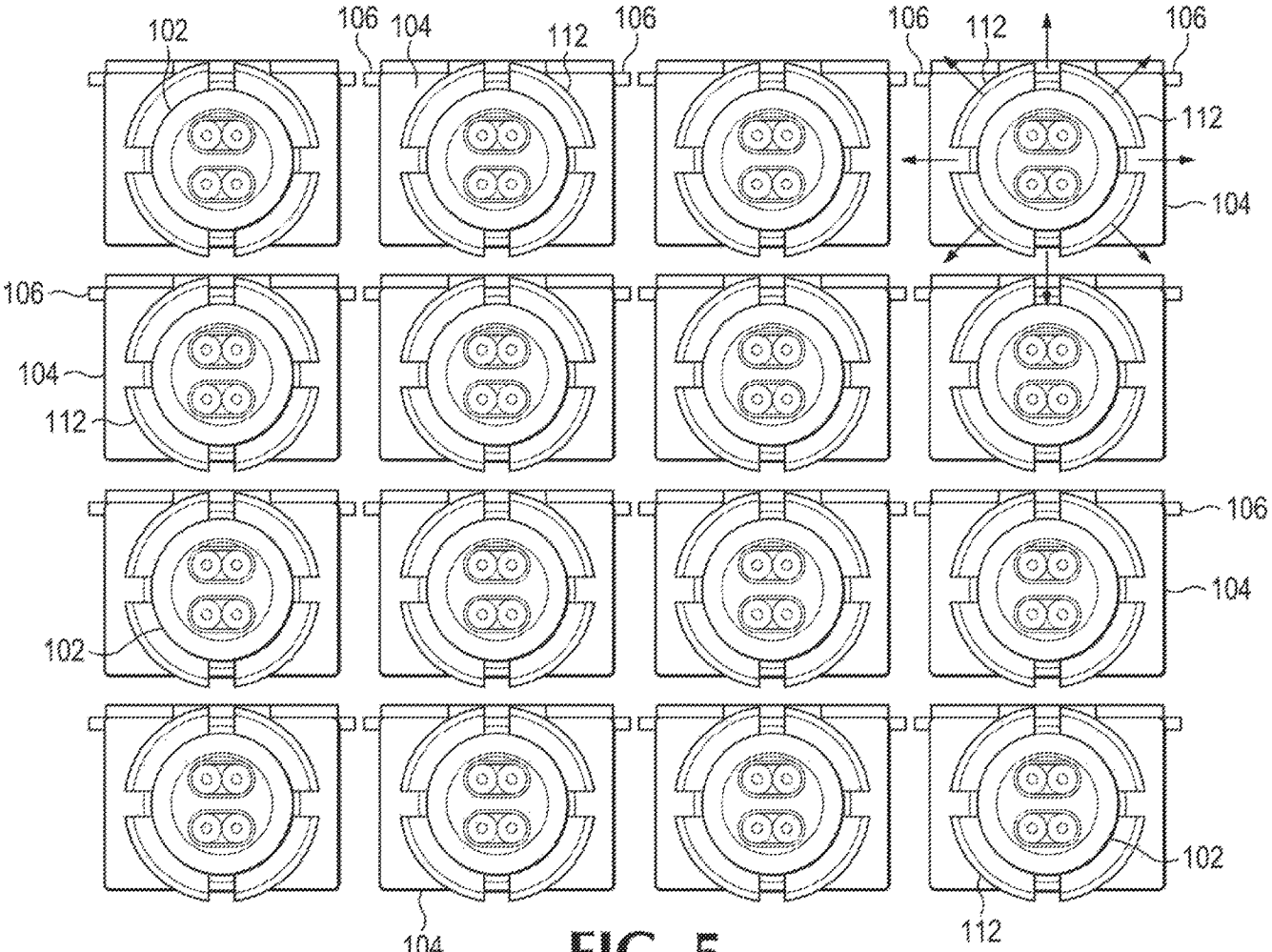
106
112
104
106
104
102
112
106
104
112
106
104
102
112
106
104
112
102
106
112
104
102
112
106
104
112
106
104
102
112
106
104
112
106
104
102
112
106
104
112
106

PULL-TABS FOR DISENGAGING A CABLE ASSEMBLY FROM A RECEPTACLE

BACKGROUND

High-radix network switch modules may support a high number of cable connectors on their faceplates. Network port standards allow 1-lane and wider ports (e.g., 12-lane for CXP), and wider ports use larger connectors and thus fewer connectors on the faceplate. Different applications use different port bandwidth. Traditionally, either 1-lane (e.g., Small Form-Factor Pluggable (SFP)) or 4-lane (e.g., Quad Small Form-Factor Pluggable (QSFP)) ports predominate the Ethernet industry.

BRIEF DESCRIPTION OF THE DRAWINGS

FIG. 5 illustrates a number of multi-way bendable cable assemblies grouped together, for example, on a faceplate of a network switch module, according to an example.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Each network port connection is provided on a network switch module in the form of a receptacle for an external cable assembly to be connected. A cable connector of the cable assembly may include latching features for coupling the cable connector to the receptacle. For removing the cable connector from the receptacle, the cable assembly may include a pull-tab to actuate the latching features for disengaging the cable connector from the receptacle.

As network switch modules may support a high number of cable connectors on their faceplates, in order to ensure that pull-tabs for each cable connector is accessible, cable routing may be limited to the directions that do not block the pull-tabs. As an example, the cable assemblies may be bent in the direction that they do not overlap or interfere with the pull-tabs. If the cable assemblies are bent in another direction, the pull-tabs may not be easily accessible. Therefore, in order to ensure accessibility of the pull-tabs, connector density on the network switch modules faceplates may be limited, since sufficient spacing may be required for the pull-tabs to be accessible and operable.

Examples disclosed herein provide a multi-way bendable cable assembly with pull-tabs for actuating latching features to disengage a cable connector from a receptacle. As will be further described, by having a number of pull-tabs wrapped around the cable assembly, at least one pull-tab may be accessible for disengaging the cable connector from the receptacle, regardless of the direction the cable assembly may be bent. As network switch modules may support a high number of cable connectors on their faceplates, and considering that the multi-way bendable cable assemblies may be bent in different directions, use of these cable assemblies may allow higher connector density on the faceplates.

Each network port connection is provided on a switch in the form of a receptacle for an external cable assembly to be connected. Although the receptacles may be implemented on the front or the rear side of a switch, this disclosure uses the term "faceplate" to generically describe where the receptacles are located for cable assemblies to be installed.

Figure 1:
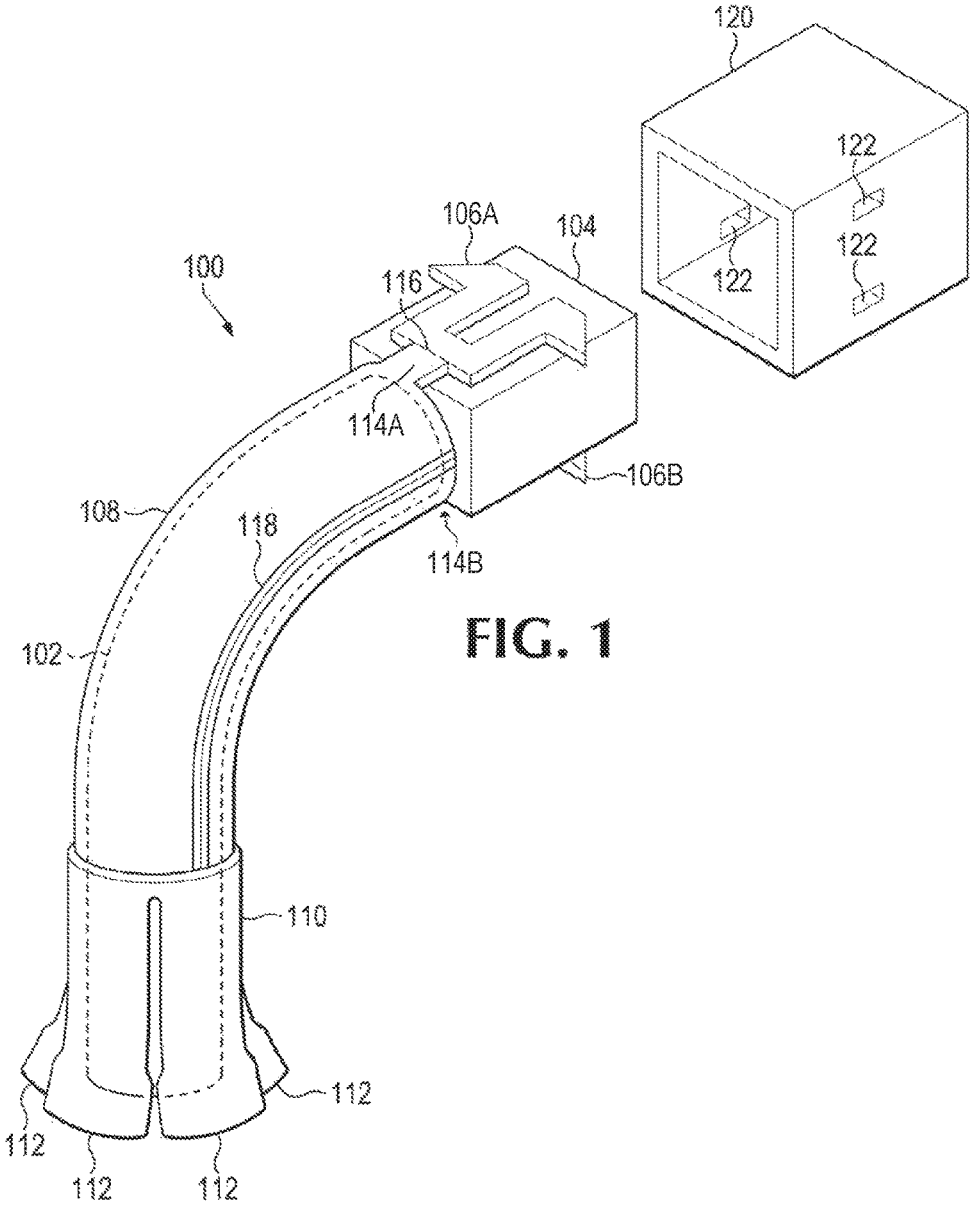
FIG. 1 illustrates a multi-way bendable cable assembly with pull-tabs, according to an example.

With reference to the figures, FIG. 1 illustrates a multi-way bendable cable assembly 100 with pull-tabs 112, according to an example. The cable assembly includes a cable 102 and a sleeve 108 enclosed around at least a portion of the cable 102. The cable 102 used in the cable assembly 100 includes, but is not limited to, electrical cables or optical fiber cables. As an example, the cable 102 may have a cable strain relief cable booth (not illustrated) disposed between the cable 102 and the sleeve 108, where the cable assembly 100 may operate independently around the cable booth.

The sleeve 108 may permanently encase at least the portion of the cable 102. However, as an example, the sleeve 108 may also be modular, and attached to the cable 102 by being wrapped around the cable 108 and secured by a fastener 118. Examples of the fastener 118 include, but are not limited to, hook-and-loop fasteners (e.g., Velcro), glue, and other types to secure the sleeve 108 to wrap around the cable 102 while allowing free movement of the sleeve 108 when the cable 102 is bent in different directions.

The cable assembly 100 may include a cable connector 104 attached to at least one end of the cable 102. Latching feature 106 may be attached to cable connector 104, for coupling the cable connector 104 to a receptacle 120 of a network switch module and ensuring a positive retention of the cable connector 104 in the receptacle 120. As illustrated, the receptacle 120 may include notches 122 for mating with the latching features 106. As an example, at least another latching feature 106 may be arranged on the opposite side of the housing of cable connector 104, as illustrated, in order to provide a more secured connector retention. As the latching features 106 are used to ensure positive retention of the cable connector 104 in the receptacle 120, other types of latching features providing such capabilities may be used than what is illustrated.

The cable assembly 100 may include a cluster 110 of pull-tabs 112 at one end of the sleeve 108. As illustrated, the pull-tabs 112 may be disposed along a perimeter of the end of the sleeve 108. As an example, depending on the diameter of the cable 102, a number of pull-tabs 112 may be included in the cluster 110 in order to wrap around the cable assembly 100 (e.g., increasing the number of pull-tabs 112 as the diameter of the cable 102 increases). As an example, the sleeve 108 and the cluster 110 of pull-tabs 112 may be a one-piece design. However, the cluster 110 may also be attachable to the sleeve 108 to allow for different clusters of pull-tabs. As a result, in addition to the sleeve 108 being modular, the cluster 110 of pull-tabs 112 may also be modular. As a result, the sleeve 108 and the pull-tabs 112 may be interchangeable with other sleeves and pull-tabs.

Referring to FIG. 1, the sleeve 108 may be attached to the latching features 106 at 116 via attachment features 114, as described above. As a result, the attachment features 114 may allow for different pull-tab sleeve designs to be used. As the cluster 110 of pull-tabs 112 may be modular, the cluster 110 may be attached to the end of the sleeve 108 opposite from the attachment features 114 (e.g., via attachment features such as hook-and-loop or glue), to allow for different pull-tab end designs to be used.

As mentioned above, the cable assembly 100 may include an attachment feature 114 along an end of the sleeve 108 opposite to the cluster 110, to couple the sleeve 108 to the latching feature 106 (e.g., at 116). Although not visible, the cable assembly 100 may include at least another attachment feature 114 to couple the sleeve 108 to the other latching feature 106 arranged on the opposite side of the housing of the cable connector 104. As will be further described, as the cable assembly 100 may be bent in any number of ways, at least one of the pull-tabs 112 may always be accessible to efficiently actuate the latching features 106 when the cable connector 104 is to disengage from the receptacle 120. As an example, an attachment feature 114 may actuate a latching feature 106 when a pull-tab 112 is pulled to disengage the connector 104 from the receptacle 120.

Figure 2A:
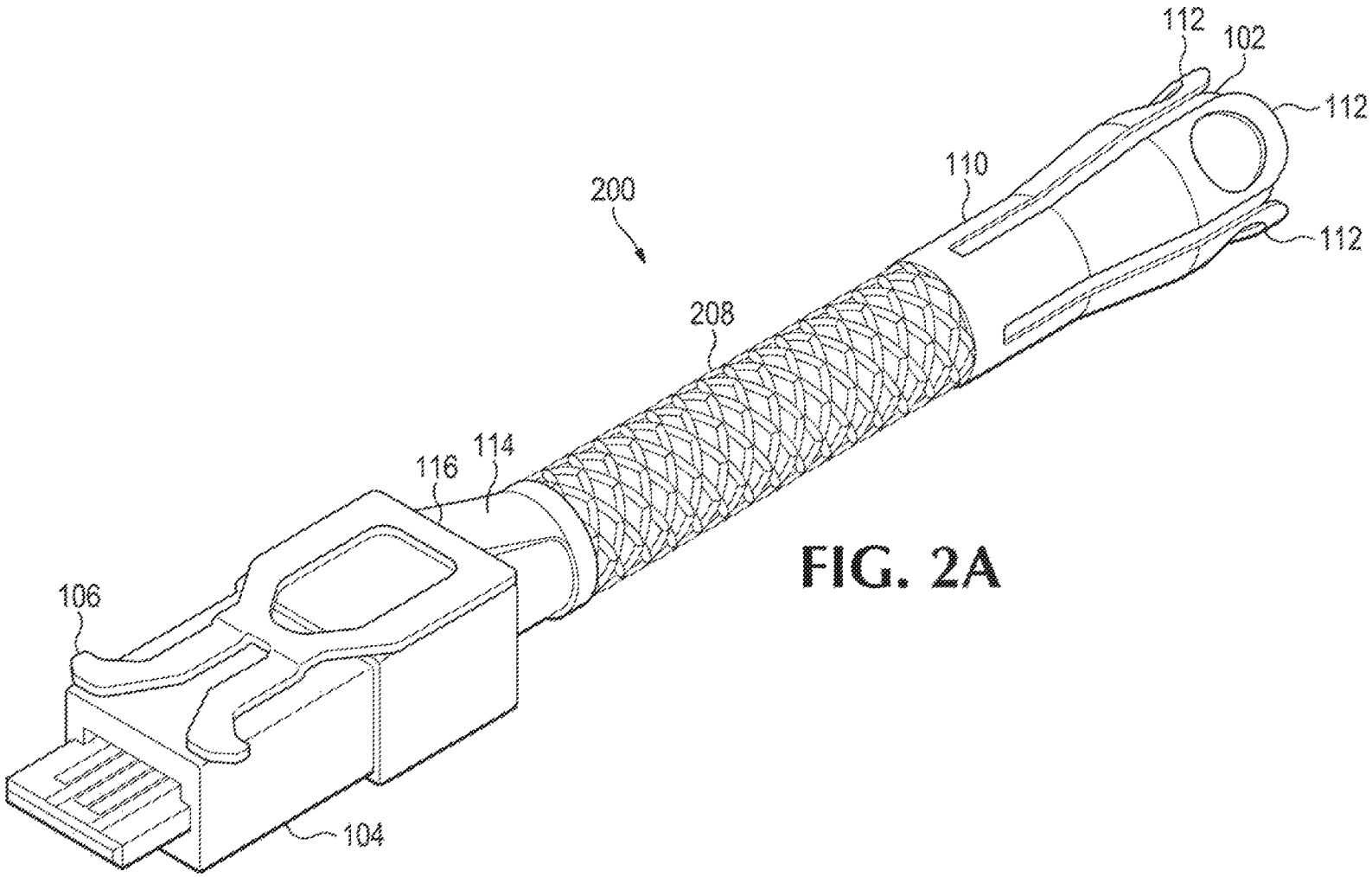
FIGS. 2A-D illustrate various views of another multi-way bendable cable assembly with pull-tabs, according to an example.
Figure 2B:
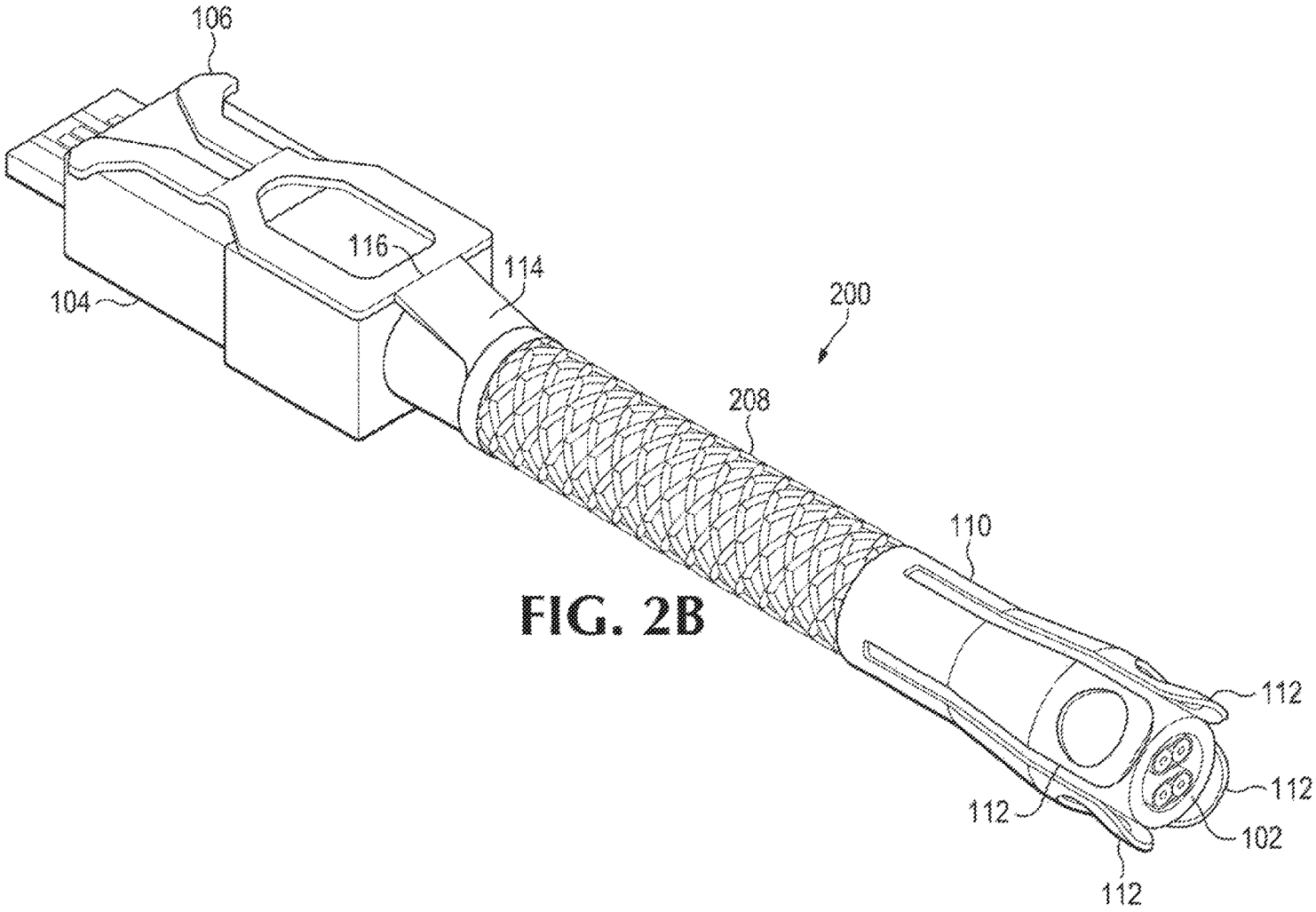
Figure 2C:
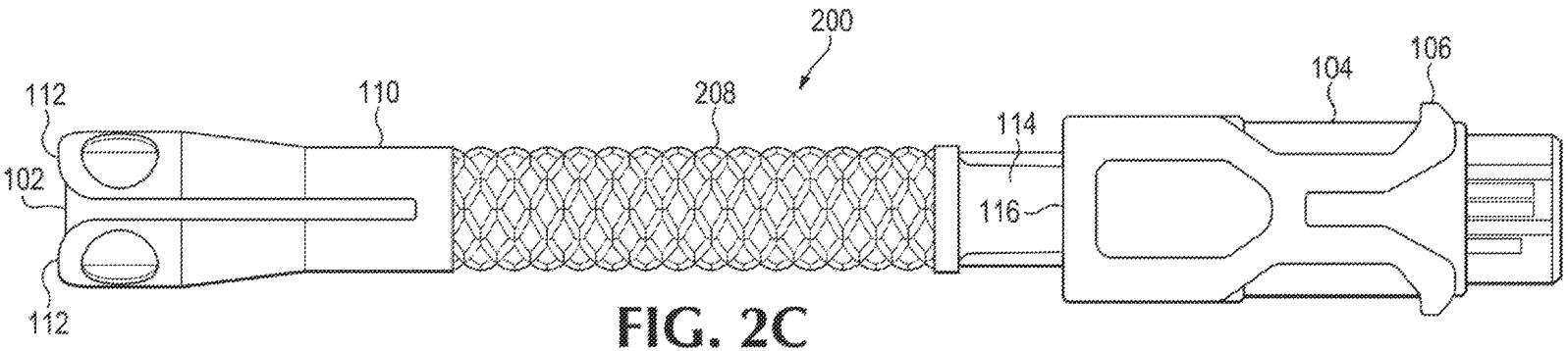
Figure 2D:
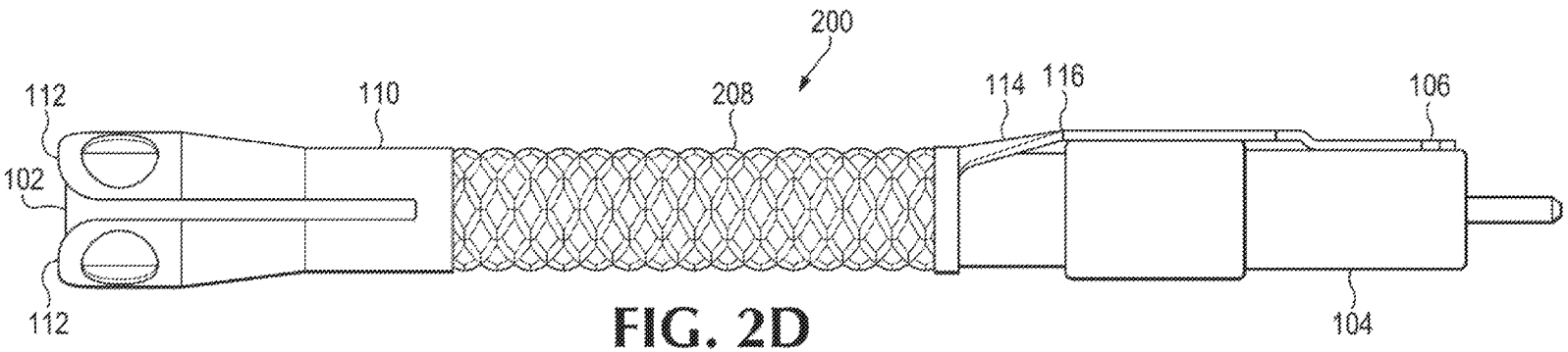

FIGS. 2A-D illustrate various views of a multi-way bendable cable assembly 200 with pull-tabs 112, according to an example. As the cable assembly 200 shares certain features similar to the cable assembly 100, the similar features may share the same reference numerals. The cable assembly 200 includes four pull-tabs 112 and one latching feature 106. However, any number of pull-tabs and/or latching features may be utilized. For example, referring back to FIG. 1, two latching features 106 are illustrated. As an example, the pull-tabs 112 may include openings, such as the ring-shaped openings illustrated. An assist tool, such as a rod with a hook, may be used to pull one of the pull-tabs 112, via the ring-shaped opening. This may be particularly useful in a densely populated faceplate. The cable 102 used in the cable assembly 200 includes, but is not limited to, electrical cables or optical fiber cables. With regards to the cable assembly 200, FIGS. 2A-B illustrate front and rear isometric views, respectively, FIG. 2C illustrates a top view, and FIG. 2D illustrates a side view.

The cable assembly 200 includes a sleeve 208, which may correspond to the sleeve 108 of cable assembly 100. As illustrated in FIGS. 2A-D, the sleeve 208 includes a meshed design. As an example, the meshed design of the sleeve 208 may have various shapes, dimensions, and patterns (e.g., also see FIGS. 3A-B) in order to efficiently transfer a pull force from at least one of the pull-tabs 112 in order to actuate the latching features 106 when disengaging the connector 104 from a receptacle. As an example, the sleeve 208 may be constructed from flexible materials including, but not limited to, plastic, metals, and wires, to allow for the cable assembly 200 to be bent in different directions while allowing a pull force of one of the pull-tabs 112 to actuate the latching features 106. Similar to the sleeve 208, the cluster 110 of pull-tabs may be made of plastic or other similar materials, according to an example.

Figures 3A, 3B:
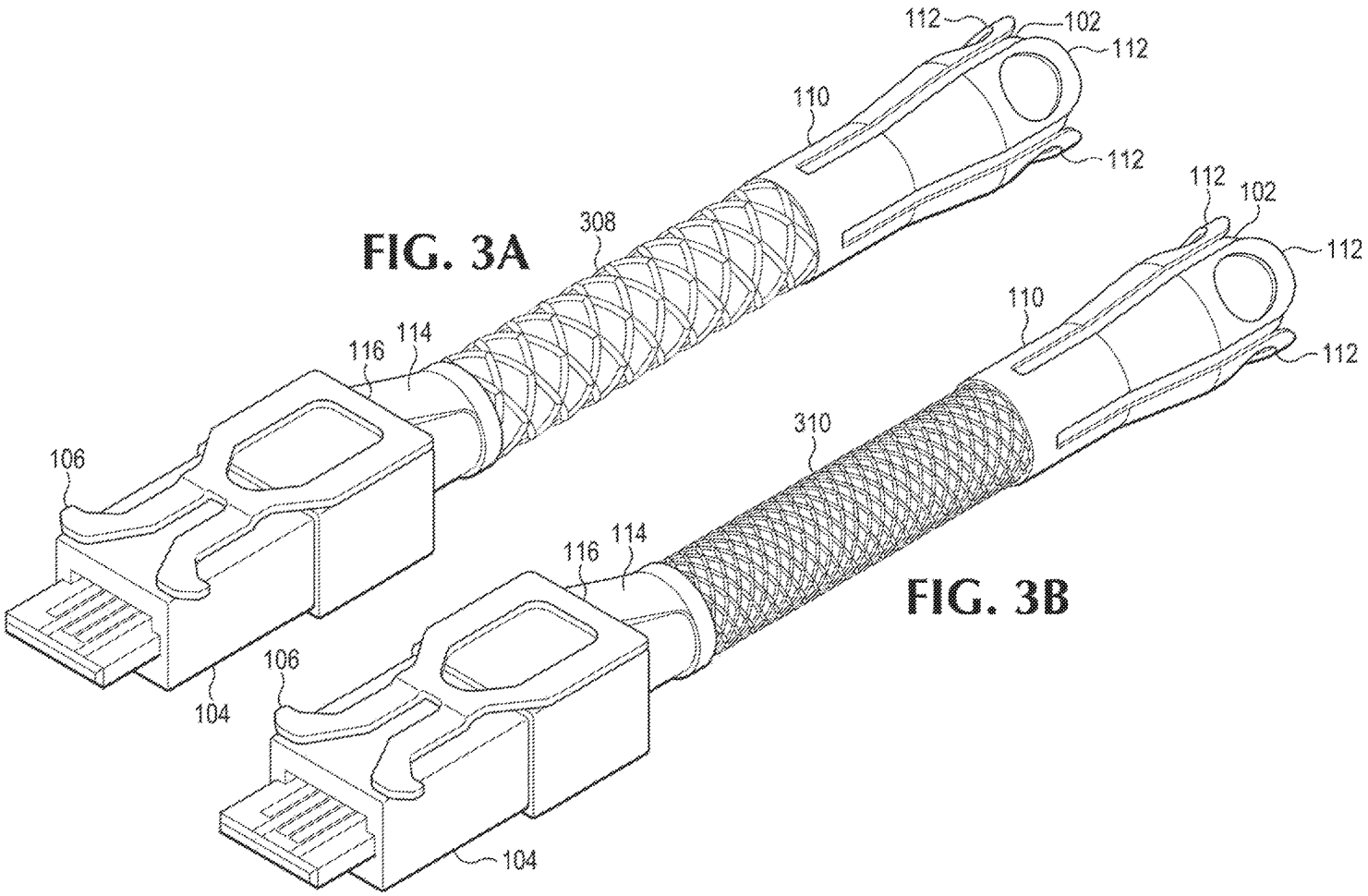
FIGS. 3A-B illustrate various examples of a meshed design that may be used for a sleeve of a cable assembly.

FIGS. 3A-B illustrate various examples of the meshed design that may be used for the sleeve of a cable assembly. Referring to FIG. 3A, sleeve 308 may have a less dense meshed design than the sleeve 208 illustrated in FIGS. 2A-D. Referring to FIG. 3B, sleeve 310 may have a more dense meshed design than the sleeve 208 illustrated in FIGS. 2A-D. The density of the meshed design may impact the flexibility of a cable assembly to be bent, as different applications may require different degrees of flexibility. In addition, as the sleeve of a cable assembly may transfer the pull force from a pull-tab in order to actuate latching features when disengaging a connector from a receptacle, the density of the meshed design may impact the amount of pull force required for disengaging the connector from the receptacle.

FIGS. 4A-F illustrate examples of different directions the multi-way bendable cable assembly 200 may be bent. As illustrated, irrespective of the direction the cable assembly 200 is bent, at least one pull-tab 112 may always be accessible for disengaging connector 104 from a receptacle. Although only one latching feature 106 and attachment feature 114 is illustrated, any number of latching features and attachment features may be utilized.

As an example, based on the number of latching features 106 used in a cable assembly, the same number of attachment features 114 may couple the sleeve to the latching features. For example, referring back to FIG. 1, two latching features 106 are illustrated, labeled 106A and 106B in FIG. 1. As a result, a first attachment feature 114A may couple the sleeve 108 to the first latching feature 106A. Similarly a second attachment feature 114B (not visible in FIG. 1) may couple the sleeve 108 to the second latching feature 106B on a side of the cable connector 104 opposite to the first latching feature 106A. Referring back to FIGS. 4A-F, although cable assembly 200 is provided as an illustration, other multi-way bendable cable assemblies, as described herein, may be bent in various directions, with at least one pull-tab always being accessible.

Figure 4A:
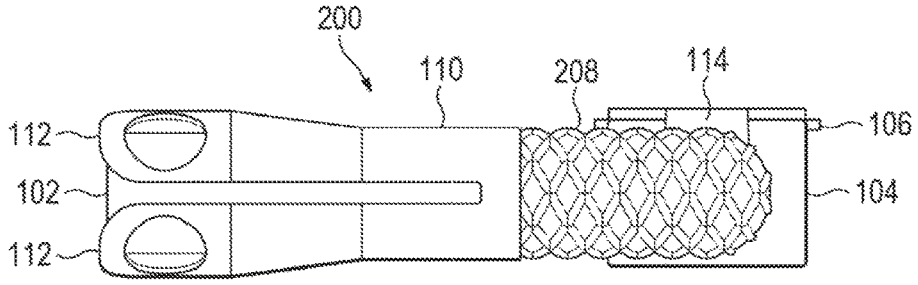
FIGS. 4A-F illustrate examples of different directions a multi-way bendable cable assembly may be bent.
Figure 4B:
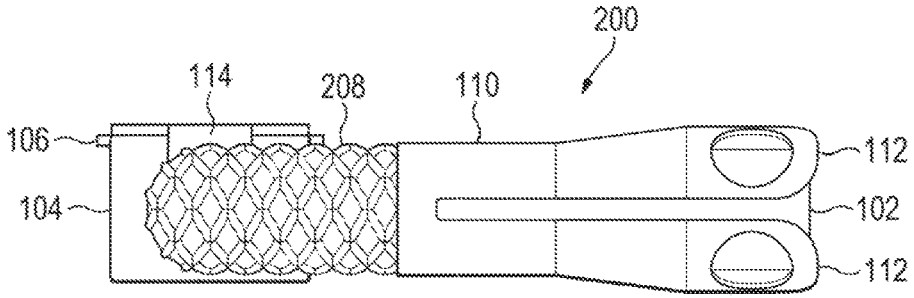
Figure 4C:
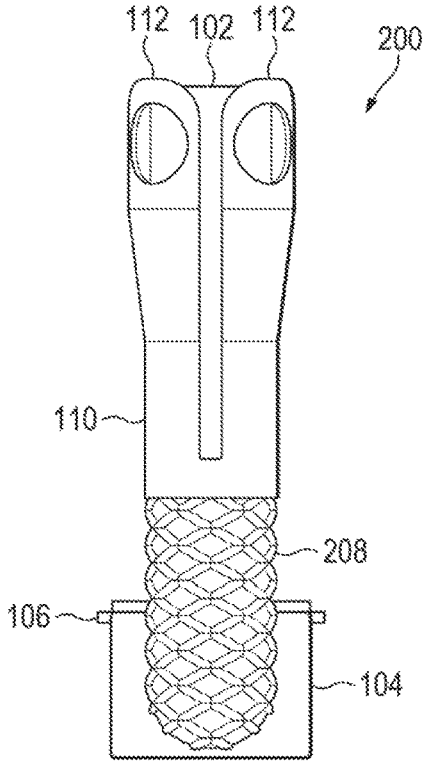
Figure 4D:
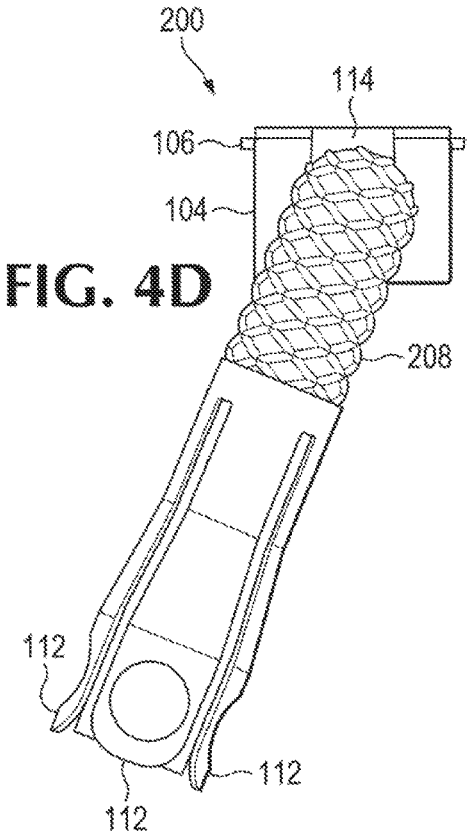
Figure 4E:
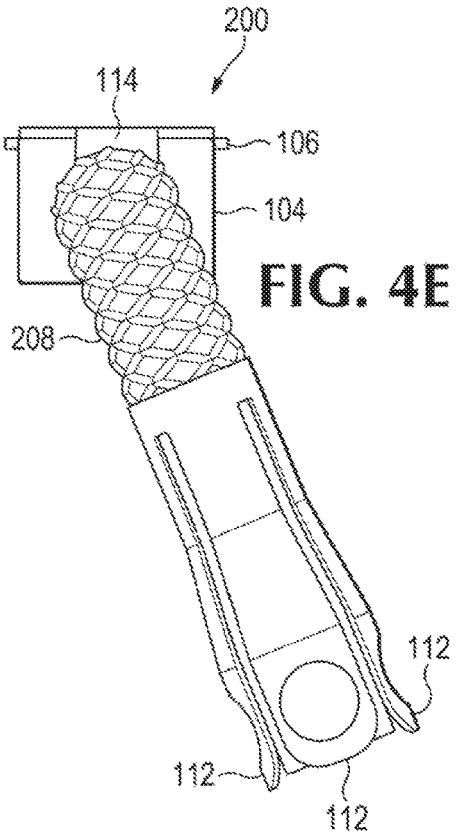
Figure 4F:
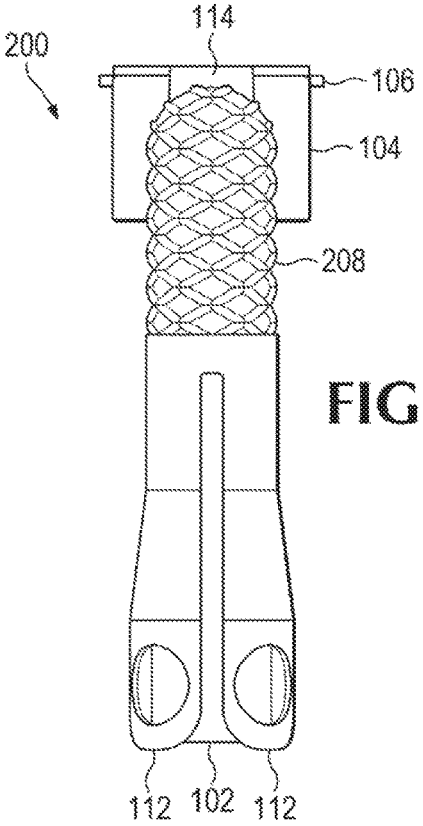

Referring to FIG. 4A, when the cable assembly 200 is bent to the left, at least two pull-tabs 112 are accessible. However, referring to FIGS. 4D-E, due to the angle of the bend of the cable assembly 200, only one pull-tab 112 may be accessible. As described above, when a pull force is applied to at least one of the accessible pull-tabs 112 (e.g., when a rod with a hook is used to pull the ring-shaped opening of an accessible pull-tab 112), the sleeve 208 may transfer the applied pull force to the latching feature 106, via the attachment feature 104, in order to disengage the connector 104 from a receptacle. As an example, the magnitude of the pull force required in order to disengage the connector 104 from the receptacle may vary, based on the direction the cable assembly 200 is bent. For example, comparing FIG. 4C to FIG. 4F, the magnitude of the pull force required for cable assembly 200 as illustrated in FIG. 4C may be greater than pull force required for the cable assembly 200 as illustrated in FIG. 4F, as the location of the attachment feature 114 may vary the magnitude of the pull force required to disengage the connector 104 from the receptacle.

FIG. 5 illustrates a number of multi-way bendable cable assemblies grouped together, for example, on a faceplate of a network switch module, according to an example. As illustrated by the arrows, and described above with respect to FIGS. 4A-F, each cable assembly may be bent in a number of different directions, with at least one pull-tab 112 from each cable assembly always being accessible for disengaging a connector 104 of the cable assembly from a receptacle. As described above, at least one pull-tab 112 may always be accessible since a number of pull-tabs 112 are wrapped around each cable assembly. As network switch modules may support a high number of cable connectors on their faceplates, and considering that the multi-way bendable cable assemblies may be bent in different directions, use of these cable assemblies may allow higher connector density on the faceplates, as illustrated. As use of these cable assemblies may allow for higher connector density, the pull-tabs 112 may include openings, such as the ring-shaped opening described above, that may be pulled by an assist tool, such as a rod with a hook, rather than by hand.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A cable assembly comprising:

a cable;

a cable connector attached to one end of the cable, wherein the cable connector comprises latching features to couple the cable connector to a receptacle;

a sleeve enclosed around at least a portion the cable;

pull-tabs disposed along a perimeter of a first end of the sleeve, wherein at least one of the pull-tabs is accessible to actuate the latching features when the cable connector is to disengage from the receptacle; and attachment features to couple the sleeve to the latching features, wherein the sleeve comprises a meshed design that is configured to transfer a pull force from at least one of the pull-tabs, when the at least one of the pull-tabs is pulled, to the attachment features such that the attachment features actuate the latching features.

2. The cable assembly of claim 1, wherein the attachment features are disposed along a second end of the sleeve opposite the first end.

3. The cable assembly of claim 1, wherein the sleeve permanently encases at least the portion of the cable.

4. The cable assembly of claim 1, wherein the sleeve is secured around at least the portion of the cable via hook-and-loop fasteners.

5. The cable assembly of claim 1, wherein the sleeve and the pull-tabs are modular, such that the sleeve and the pull-tabs are interchangeable with other sleeves and pull-tabs.

6. The cable assembly of claim 1, wherein the latching features comprise at least a first latching feature on a first side of the cable connector and a second latching feature on a second side of the cable connector opposite the first side of the cable connector.

7. The cable assembly of claim 1, wherein the cable assembly includes a cable strain relief cable booth disposed between the cable and the sleeve.

8. The cable assembly of claim 6, wherein the attachment features comprise at least a first attachment feature to couple the sleeve to the first latching feature and a second attachment feature to couple the sleeve to the second latching feature.

9. The cable assembly of claim 1, wherein the pull-tabs comprise ring-shaped openings, and wherein a pull-tab actuates the latching features when a tool is to pull the pull-tab via the ring-shaped opening of the pull-tab.

10. A cable assembly comprising:

a cable;

a cable connector attached to one end of the cable, wherein the cable connector comprises a first latching feature on a first side of the cable connector and a second latching feature on a second side of the cable connector opposite the first side, wherein the latching features are to couple the cable connector to a receptacle;

a sleeve enclosed around at least a portion the cable;

pull-tabs disposed along a perimeter of a first end of the sleeve, wherein at least one of the pull-tabs is accessible to actuate at least one of the latching features when the cable connector is to disengage from the receptacle; and attachment features to couple the sleeve to the latching features, wherein the sleeve comprises a meshed design that is configured to transfer a pull force from at least one of the pull-tabs, when the at least one of the pull-tabs is pulled, to the attachment features such that the attachment features actuate the latching features.

11. The cable assembly of claim 10, wherein the sleeve and the pull-tabs are modular, such that the sleeve and the pull-tabs are interchangeable with other sleeves and pull-tabs.

12. A cable assembly comprising:

a cable;

a cable connector attached to one end of the cable, wherein the cable connector comprises latching features to couple the cable connector to a receptacle;

a modular sleeve enclosed around at least a portion the cable;

modular pull-tabs disposed along a perimeter of a first end of the sleeve, wherein the sleeve is to transfer a pull force from at least one of the pull-tabs to actuate the latching features when the cable connector is to disengage from the receptacle; and attachment features to couple the sleeve to the latching features, wherein the sleeve comprises a meshed design that is configured to transfer a pull force from at least one of the pull-tabs, when the at least one of the pull-tabs is pulled, to the attachment features such that the attachment features actuate the latching features.

13. The cable assembly of claim 12, wherein the modular sleeve is secured around at least the portion of the cable via hook-and-loop fasteners.

* * * * *